United States Patent [19]

Dickey

[11] 3,983,651

[45] Oct. 5, 1976

[54] APPARATUS FOR THE PRESENTATION OF READING MATERIALS

[75] Inventor: Herbert C. Dickey, North Reading, Mass.

[73] Assignee: The Ealing Corporation, Cambridge, Mass.

[22] Filed: May 28, 1975

[21] Appl. No.: 581,589

[52] U.S. Cl. ..... 40/343; 40/31; 40/347

[51] Int. Cl.[2] ..... B41J 11/00

[58] Field of Search ..... 35/35 B; 40/31, 86 R, 40/86 A, 104 A, 343, 347

[56] References Cited

UNITED STATES PATENTS

| | | | |
|---|---|---|---|
| 2,078,834 | 4/1937 | Brennan | 40/31 |
| 2,549,452 | 4/1951 | Green | 40/86 R |
| 2,803,900 | 8/1957 | Jones | 40/31 |
| 2,837,294 | 6/1958 | Jacobs | 40/31 X |
| 2,950,543 | 8/1960 | Ritter et al. | 35/35 B UX |
| 3,087,268 | 4/1963 | Rice | 40/104 A |
| 3,293,782 | 12/1966 | Drexler | 40/31 |
| 3,302,309 | 2/1967 | Macomber | 35/35 B |
| 3,364,604 | 1/1968 | Donaldson et al. | 40/31 |
| 3,510,973 | 5/1970 | Mazzocco, Sr. | 40/31 |
| 3,882,620 | 5/1975 | Grindle | 40/343 |

*Primary Examiner*—William H. Grieb
*Attorney, Agent, or Firm*—Anthony H. Handal

[57] ABSTRACT

A reading apparatus is disclosed which is especially adapted for use by handicapped persons. The apparatus presents reading material such as books, magazines, newspapers and the like to be read in the reflected light of normal room lighting or a reading lamp. The reading material comprises a plurality of pages disposed on a continuous sheet or scroll which is contained within a reel to reel cassette. The cassette is received within a console which includes motor means for advancing the sheet and thereby causing the pages to be successively displayed through a window on the console when the reels are driven by the motor means.

15 Claims, 17 Drawing Figures

FIG.5.
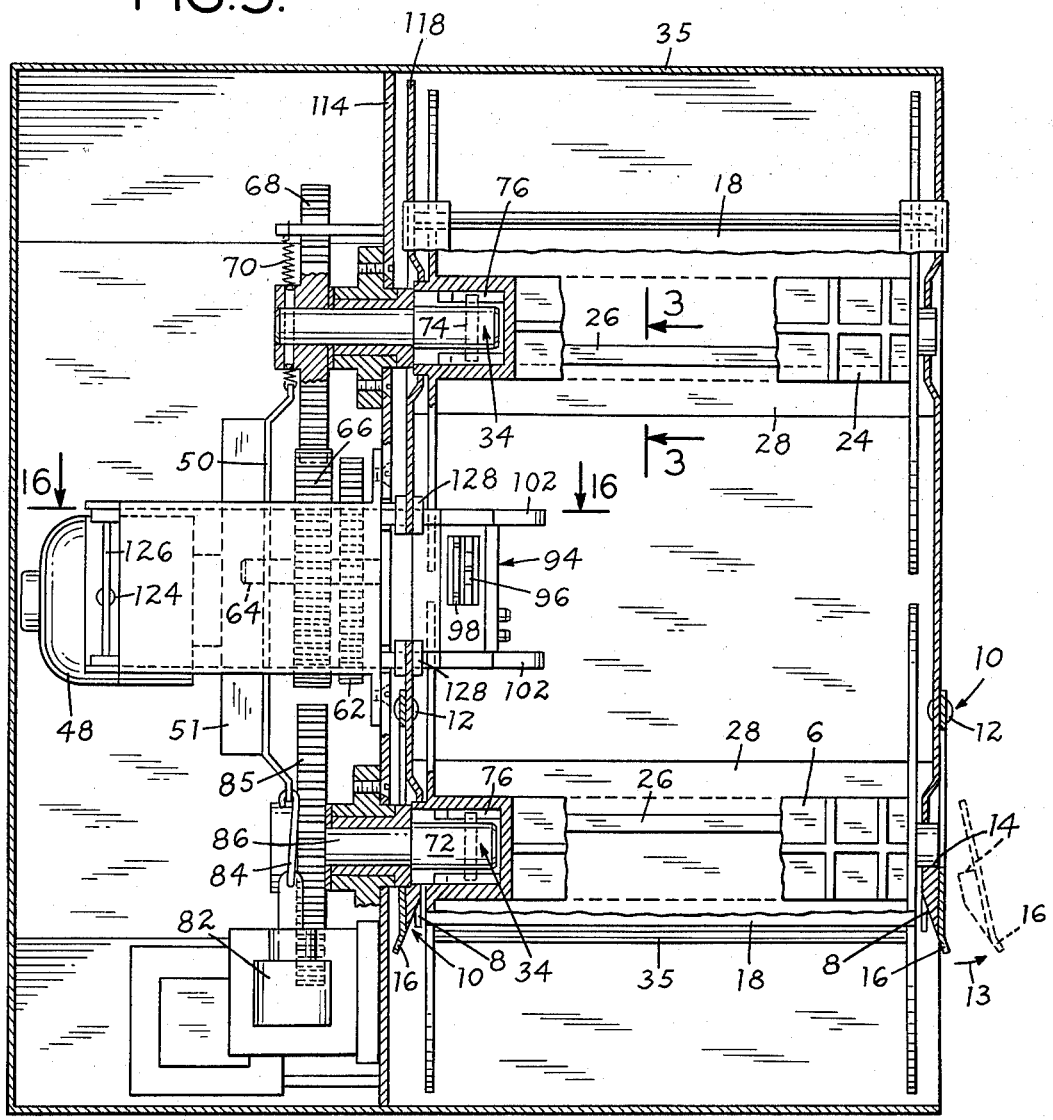
FIG.3.
FIG.10.
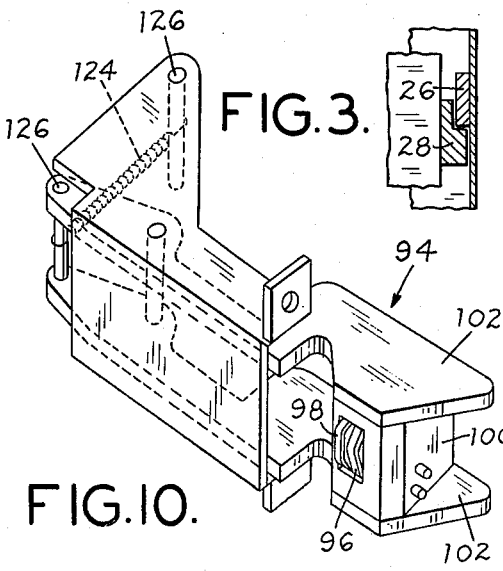
FIG.11. FIG.12. FIG.13.
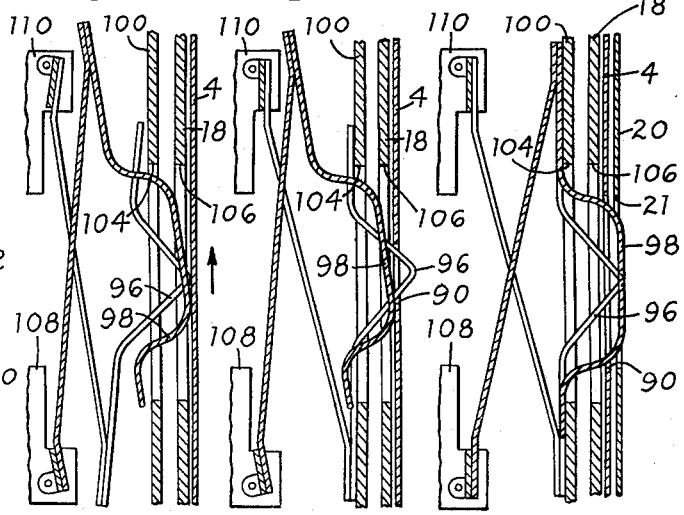

APPARATUS FOR THE PRESENTATION OF READING MATERIALS

BACKGROUND OF THE INVENTION

The present invention relates to devices used for displaying reading materials. More particularly, the present invention relates to a device for the presentation of a variety of lengthly printed reading materials which may be conveniently used by handicapped persons.

There exists in the prior art a variety of reading and teaching devices, such as those of the microfilm or television variety. Microfilm readers, television systems and related projected light or Cathode Ray Tube (CRT) scanning type devices have been found to be inadequate for the presentation of reading material because they are very tiring to the eyes. This is particularly true if such devices are used to present lengthy reading materials such as books, magazines, newspapers and the like.

Some teachings machines have been known which present reading material of limited length under ordinary lighting conditions. However, such devices are large, cumbersome machines which are not amenable to use by handicapped persons and are not known to have been used for presenting ordinary reading materials of any length such as books, newspapers, magazines and the like.

Yet another teaching device is disclosed in U.S. Pat. No. 3,882,620, entitled, Apparatus and Method for Presentation of Reading Materials which is incorporated herein by reference. This apparatus comprises a feed spool and a take-up spool in a housing which includes an aperture. A sheet wound on both spools and containing the desired reading material is displayed through the aperture as it passes from the feed spool to the take-up spool. The spools are driven by a motor which is controlled by index marks on the sheet. Thus, during operation, successive sheets are displayed through the aperture in the console, allowing the pages to be read by ambient light. Although this machine solves many of the problems of earlier reading devices, it lacks a measure of convenience in use, especially in the selection of various items of reading material. The device of the present invention is a rugged, compact apparatus which is adaptable for use by even the most severly handicapped and which may be most conveniently provided with diverse items of reading material. The present invention may even be used by a person who is incapable of any movement of his extremities. Heretofore, persons born with such severe handicaps were not even taught how to read because of the extreme frustration such a disability causes in the absence of reading material which they can use with relative independence. The device of the present invention will make available to such persons a wide variety of reading materials which they can read without the constant help of another person, and which may be varied by another person with relative ease.

SUMMARY OF THE INVENTION

In accordance with the present invention, an apparatus for presenting reading material in the form of a single continuous sheet is provided. The sheet is of the variety having a plurality of pages of printed material as well as control information disposed on it. The control information indicates the position of each of the pages.

The invention contemplates the material to be read by direct viewing by reflected light. The apparatus comprises a cassette, which has a facing portion, for containing the sheet. A console is provided for defining an aperture large enough for a portion of the sheet corresponding to at least one page of the reading material positioned on the console and for defining a cassette receiving chamber. The aperture is positioned in such a manner that the facing portion of the cassette is subadjacent the aperture when the cassette is in the cassette receiving chamber. The console includes means for guiding the cassette into the cassette receiving opening in the console. A feed spool mounted in the cassette is provided for supporting the single sheet in roll form within the casette. Means is provided for guiding the sheet along a path extending from the feed spool and passing over the facing portion of the cassette. A take-up spool takes up the sheet from the guiding means. The spools include means for coupling them to a source of rotary drive. A motor drives a transmission which is associated with the console and has first and second modes for coupling the motor automatically to either the take-up spool or the feed spool. A detector is provided for detecting the control information control means responsive to the detector is provided for controlling the motor and switching the transmission between the first and second modes. In the first mode, this causes unwinding of the sheet from the feed spool and onto the take-up spool, thereby advancing the sheet along the path past the aperture causing successive pages of the reading material to be displayed through the aperture.

In the second mode, the transmission couples the motor to the feed spool causing the sheet to be rewound on the feed spool.

BRIEF DESCRIPTION OF THE DRAWINGS

The nature, advantages, and various features of the invention will appear more fully upon consideration of the illustrative embodiment now to be described in detail in connection wih the accompanying drawing in which:

FIG. 3, is a vertical section along line 3—3 of FIG. 5 showing the rail structure which aids the sliding of the cassette into position;

FIG. 5, is a vertical section along line 5—5 of FIG. 2;

FIG. 10, is a perspective view of the switch housing, showing bothcontrol information detecting actuating arms extended;

FIG. 11, is a perspective view of the switch housing showing the sheet deflecting both actuating arms;

FIG. 12, shows the end-of-sheet actuating arm being deflected by the sheet;

FIG. 13, shows both the end of sheet and page switches in the undeflected position;

DETAILED DISCRIPTION OF THE PREFERRED EMBODIMENT

Figure 1:
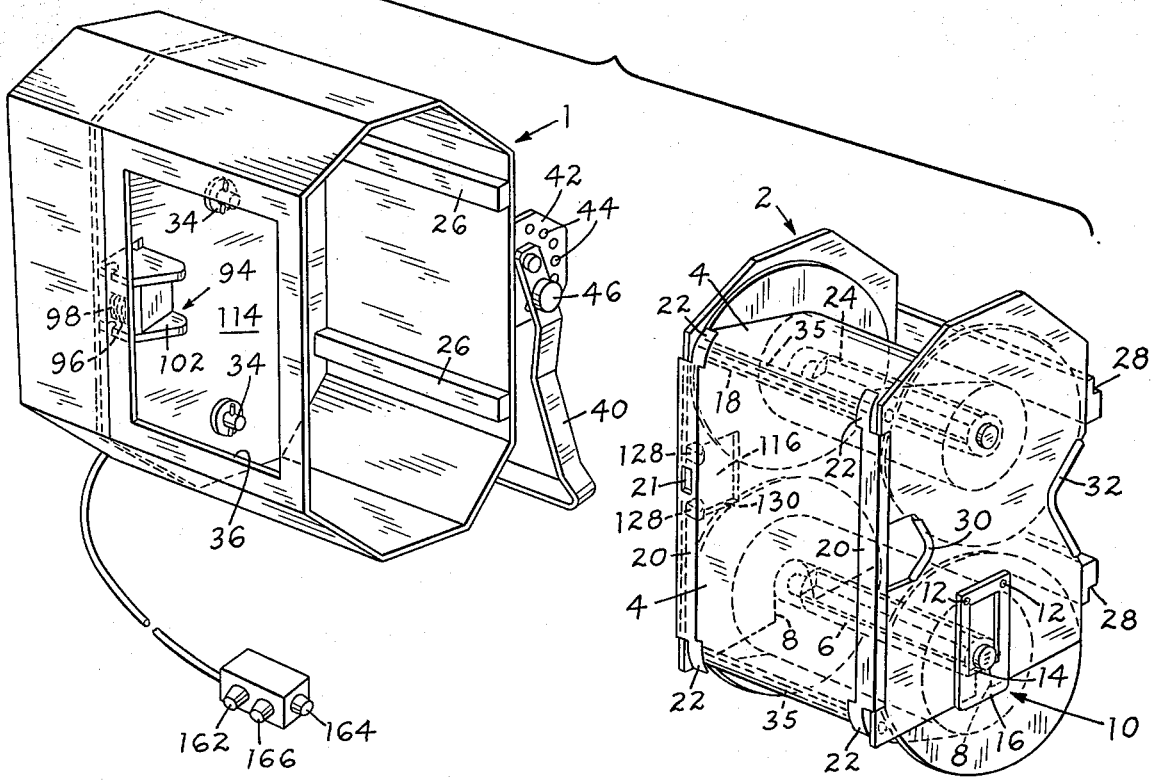
FIG. 1, is an exploded view, showing the console and cassette of the present invention in perspective.

Referring to FIGS. 1–17, the reading apparatus constructed in accordance with the present invention comprises a console 1 which accepts a cassette 2. When it is desired to read a particular item of reading material, a cassette containing a sheet 4, which has that material printed on it, is inserted into the console 1. The contents of cassette 2 may, in turn, be varied by substituting another sheet 4.

Different sheets 4 may be employed by inserting a feed spool 6 with the desired material printed on it into cassette 2 when the cassette is removed from console 1. The entry of spool 6 into cassette 2 against resilient locking members 10 which are secured to the body of cassette 2 by rivets 12 is guided by guide slots 8. Members 10 are deflected in the direction of arrow 13 (FIG. 5) during entry and snap back to the illustrated position when insertion is completed. Spool 6 is held in position by flat surface 14 of members 10. When it is desired to remove spool 6 from cassette 2, it is merely necessary to displace end 16 of resilient locking members 10 away from the body of cassette 2 thereby allowing the end of spool 6 to pass beneath surfaces 14 of the resilient locking members and from there out of the cassette. Druing display of the reading material on sheet 4, sheet 4 proceeds from spool 6 around facing plate 18 of cassette 2. Sheet 4 is aided in proper alignment with and adjacent to facing plate 18 by a pair of guide rails 20, one of which includes a hole 21, at opposite edges of cassette 2. Further control is provided by four curved extensions 22 attached to guide rails 20. After passing over facing plate 18, sheet 4 is rolled onto a take-up spool 24.

The insertion of cassette 2 into console 1 is guided by a pair of rails 26 on console 1 and a pair of matching tracks 28 on cassette 2. Convenient gripping surfaces are provided by edging strips 30 and 32, which may be made of plastic or any other suitable material.

During use spool 24 is driven by coupling 34 causing the unwinding of sheet 4 from spool 6 around idler 35 and display of the information printed on sheet 4 through viewing aperture 36. Similarly, when it is desired to rewind the sheet spool 6 is rotated by a coupling 38 causing the winding of sheet 4 on spool 6. Sheet 4 may be secured to spool 6 or spool 24 by any suitable means such as cellophane tape or any other similar means.

Console 1 is supported in the desired angular position by a support arm 40 which is rotatably secured to a bracket 42. Bracket 42 includes a number of locking holes 44. These holes allow the support arm 40 to be secured to bracket 42 in any desired angular position by a bolt 46 which extends through arm 40 and bracket 42 thereby allowing the module to be set at any desired viewing angle. Bolt 46 may either be threadedly mounted in bracket 42 or urged into holes 44 by a spring.

Figure 4:
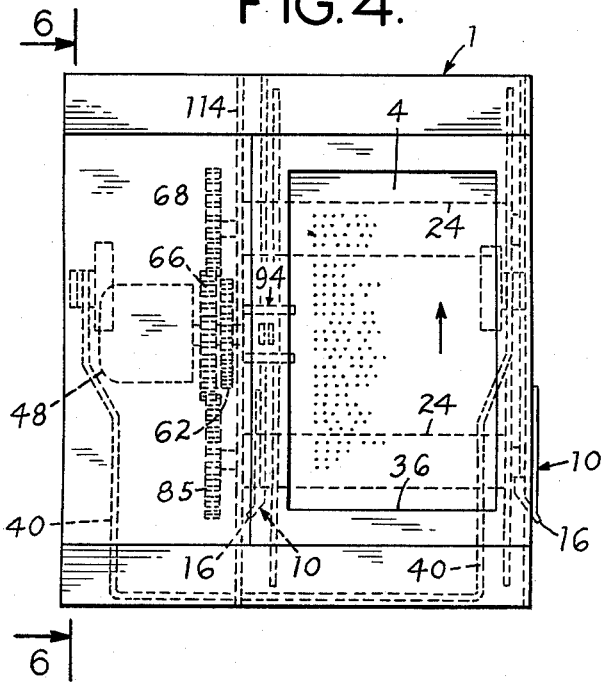
FIG. 4, is a front view of the reading apparatus with the cassette in position.
Figure 2:
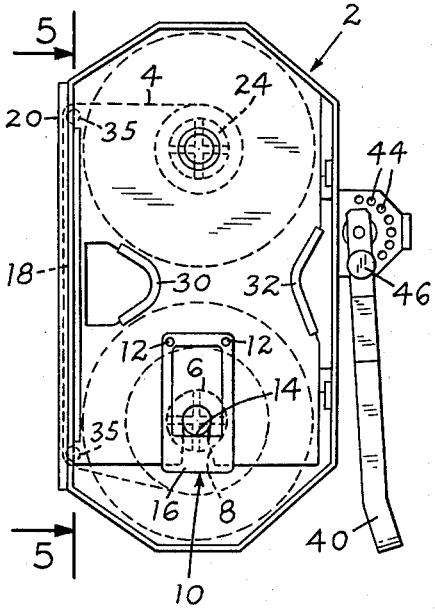
FIG. 2, is an end view of the apparatus with the cassette in position.
Figure 7:
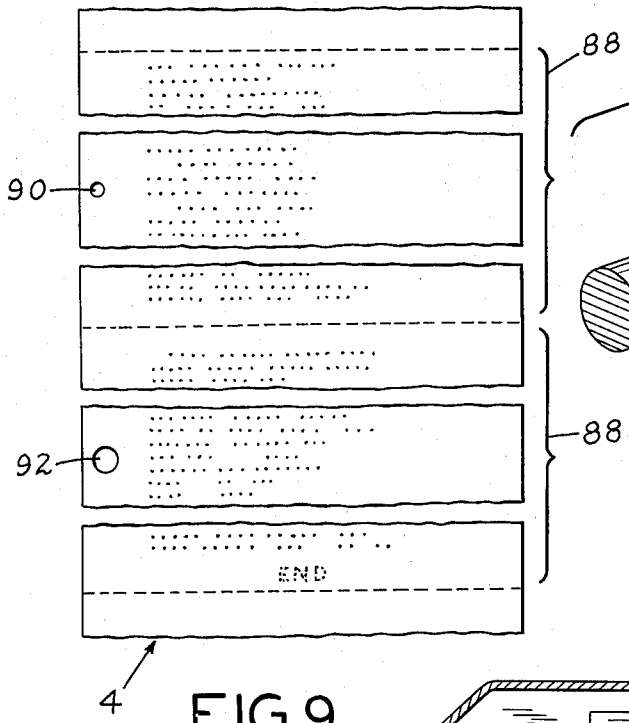
FIG. 7, is an exploded viewin perspective, showing means for coupling the cassette to the source of drive.
Figure 8:
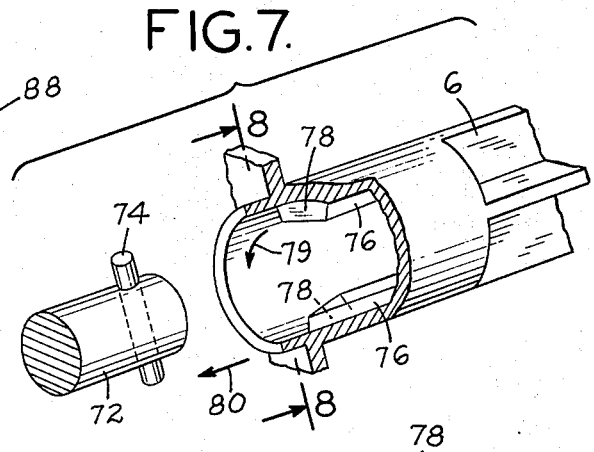
FIG. 8, is a section along line 8—8 of FIG. 7, showing the coupling complete.
Figure 6:
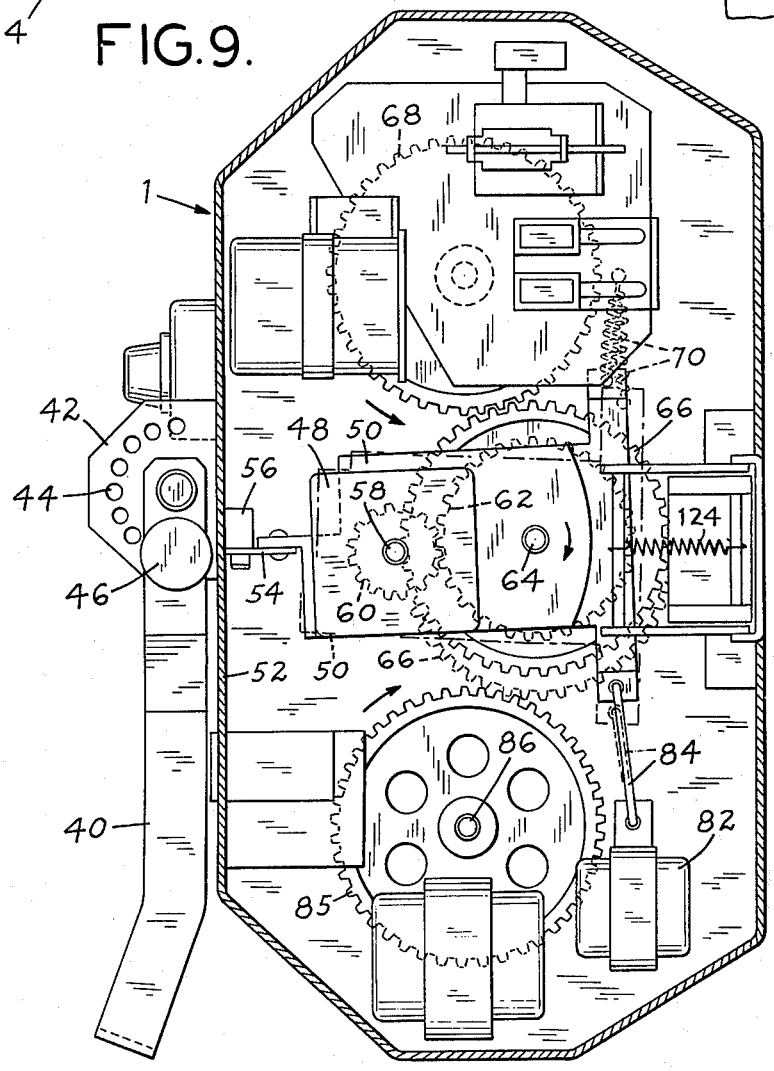
FIG. 6, is a vertical section along line 6—6 of FIG. 4.

Referring to FIGS. 4 – 6, motor drive for the winding and unwinding of sheet 4 is supplied by a motor 48. Motor 48 is mounted on plate 50, which in turn is hingedly secured to the casing 52 of console 1 by a resilient member 54 and a bracket 56. Motive power is coupled from the shaft 58 of motor 48 by a gear 60. Gear 60 in turn couples power to gear 62 which together with a second gear 66 is secured to a common shaft 64. Alternatively, additional intermediate gears may be used to change the output speed.

Normally gear 66 is urged into engagement with gear 68 by a spring 70. Gear 68 is in turn coupled to coupling 34. Couplings 34 and 38 comprise a shaft 72 within which a pin 74 is mounted. As it is shown most clearly in FIGS. 7 and 8 pin 74 mates with a complementary abutment 76 on the inside of the spools. Abutments 76 include chamfered surfaces 78. These chamfered surfaces guide the spools 6 and 24 into proper registration with the couplings 34 and 38 during insertion of the cassette 2 into console 1. Surfaces 78 are so cut that during insertion of the spool in the direction indicated by arrow 80, should pin 74 be aligned with aubtments 76, pin 74 will engage surfaces 78 of abutments 76 causing rotational movement between the spool and the coupling in the direction indicated by arrow 79. This will then cause the spool and the coupling to have the relative positions illustrated in FIG. 8.

When, in turn, it is desired to rewind sheet 4 on spool 6, a solenoid 82, coupled to plate 50 by a linkage 84, is actuated causing displacement of plate 50 to the position indicated in phantom lines in FIG. 6. In this position gear 66 engages rear 85 which is in turn coupled via shaft 86 and coupling 38 to spool 6. Additionally, the direction of motor 50 is electrically reversed thereby causing the rewinding of sheet 4 on spool 6.

Figure 9:
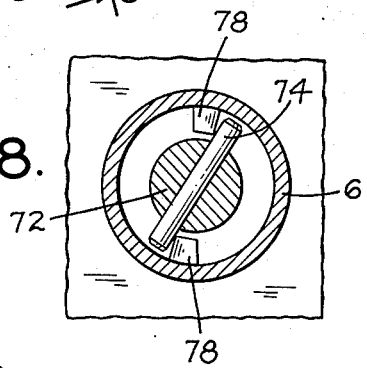
FIG. 9, is a front view of a sheet used in the machine.

Sheet 4 contains a plurality of pages 88 of printed matter. As is illustrated in FIG. 9, each of the pages includes an index mark in the form of a punched hole. These holes take two forms namely a small hole 90 or a large hole 92. The small holes 90 indicate the position of the page while the large hole 92 indicates the position of the last page of the sheet. Thus large hole 92 serves to stop the further forward advancement of sheet 4 during reading.

The presence of a large or small hole is sensed by a sensing assembly 94 which is positioned near the center of one of the side portions of window 36 (See FIG. 1). Position sensing assembly 94 includes a pair of switches having actuating arms which are selectively responsive to the presence of a small or large hole. One of the switches has a pointed actuating arm 96 while the other of the switches has a flat actuating arm 98. Both of these switches aare included within a housing 100 which is positioned between a pair of pivotally supported cams 102. The operation of these switches is illustrated in FIGS. 11–13. During advancement of sheet 4 within the cassette, actuating arms 96 and 98 extend through a hole 104 in housing 100 and, a second hole 106 in front plate 18. Arms 96 and 98 thus bear against sheet 4, as is illustrated in FIG. 11. When a page 88 (FIG. 9) becomes aligned with aperture 36 (FIG. 1) the pointed actuating arm associated with switch 110 is permitted to pass through hole 90 thereby actuating switch 110 and providing control information indicating that a page is centered within the viewing aperture. This situation is illustrated in FIG. 12. When the final page is reached large hole 92 is then disposed over actuating arms 96 and 98. This causes actuating arms 96 and 98 to pass through hole 92 actuating both switches, as is illustrated in FIG. 13.

Figure 14:
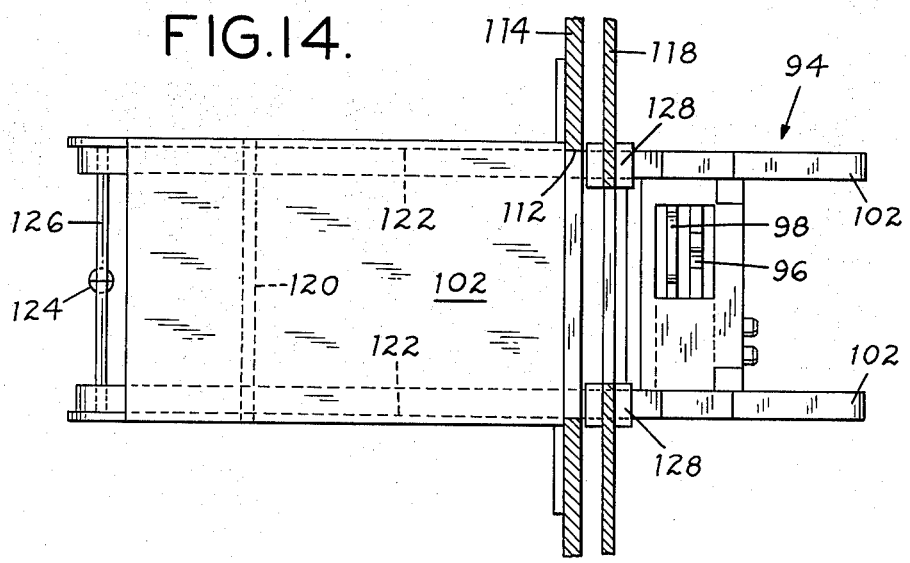
FIG. 14, is a front view of the position sensing assembly, showing the page and end of sheet detector actuating arms.
Figure 15:
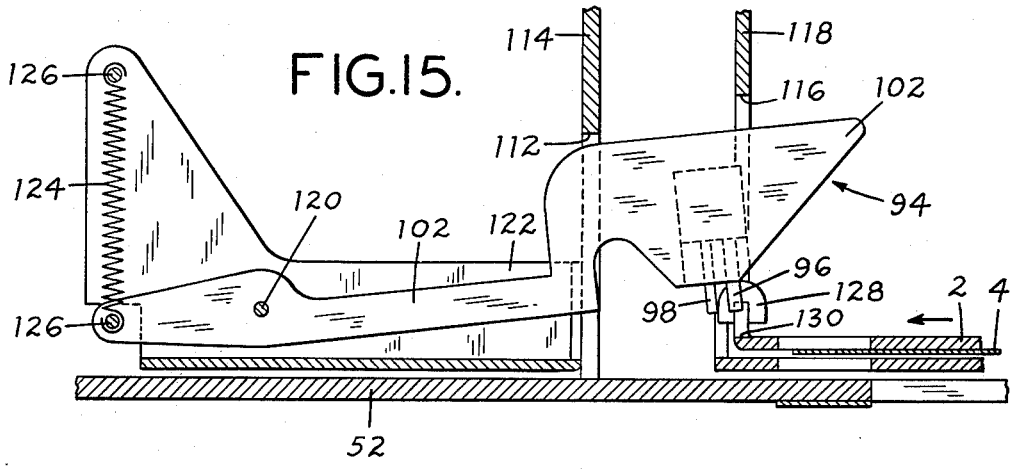
FIG. 15, is a plan view of the same assembly showing the relative positions of the elements when the cassette is being inserted.
Figure 16:
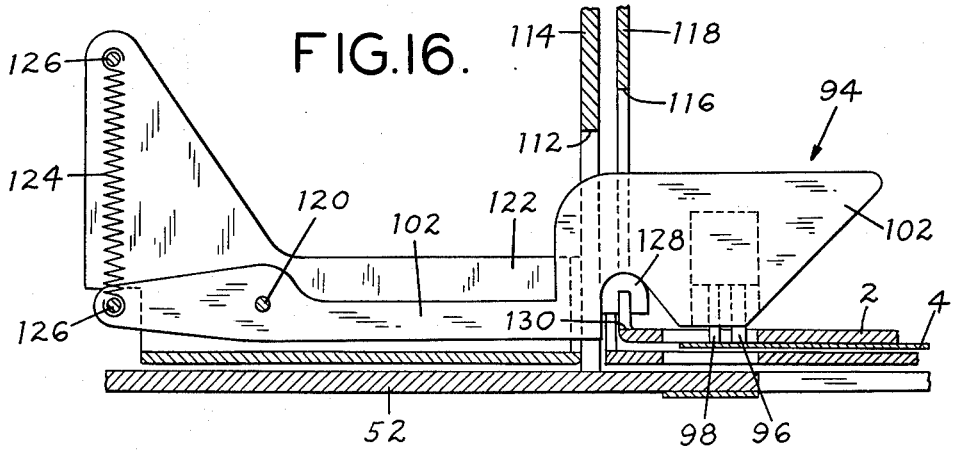
FIG. 16, is a plan view along line 16—16 of FIG. 5 of the same assembly showing the cassette in position.

Sensing assembly 94 is illustrated in the operating position in FIG. 14. In this position it extends through a hole 112 in dividing support wall 114 of console 1. It then proceeds through a hole 116 in side wall 118 of cassette 2. Cams 102 are pivotally mounted on a pin 120 which extends through U-shaped support member 122 which in turn is secured to the outer casing 52 of the console. Cams 102 are urged into the desired position by a spring 124 which is secured to cams 102 and support member 122 by a pair of pins 126. During entry of the cassette into the console, as is illustrated in FIG. 15, cams 102 are deflected by a cam follower 128. This causes actuating arms 96 and 98 to clear surface 130 of hole 116, and allows the cam elements, with their associated switches to enter the cassette. Cams 102 and cam followers 128 may be made of delrin or any other similar material which has the desired low friction characteristics. In the position illustrated in FIG. 16, the switch actuating members 96 and 98 are thus then free to extend through housing 100 and hole 106, thereby detecting the position of the pages and providing centering information.

CONTROL CIRCUITRY

Power from a 115 volt AC source is connected to the circuitry via a dpst switch 132. Closure of switch 132 activates a pilot lamp 134, thereby indicating that the machine is on. This also couples power to the motor control circuitry which is powered by a transformer 136. The motor control circuitry includes a motor actuating relay 138 having normally open contacts 140 and 142 and normally closed contacts 144. Reversal of the motor is controlled by reversal relay 146 which is a latching relay having first and second states. Reversal relay 146 includes contacts 148, 150 and 152 which are open in the first of said states and contacts 154 and 156 which are closed in the first state. Whenever a pulse of electrical current is passed through relay 146, it switches from the first state to a second state in which its open contacts become closed and its closed contacts become opened. It remains in this state even after the pulse has ceased. It may then be brought back into its original position by the application of another pulse of power to its coil.

The contacts of relay 146 disable control functions which are associated with forward movement of the sheet and actuate those components of the circuit such as the reversing solenoid 82, which enable reverse movement or rewinding of the sheet.

Actuation of a timer circuit is achieved by timer relay 158. Timer relay 158 has contacts 160 and is a latching relay whose contacts change their state from open to closed or closed to open whenever a pulse is applied to the coil of relay 158. It thus operates in much the same manner as relay 146.

Control of the circuit by the user is accomplished by three remote switches, namely, forward switch 162, reverse switch 164 and timer switch 166. These switches may take any desired form, such as breath-operated switches or the like, which the handicapped person is able to use. Closing of the forward switch causes the motor to advance, closure of the reverse switch causes reversal of the motor and rewinding of the sheet while closure of the timer switch 166 causes the reading apparatus to assume a mode of operation where the machine automatically advances to a new page, remains at that page for a predetermined period of time and then advances to the next page, thus successively displaying each of the pages on the sheet for that predetermined period of time. This period of time may be varied and is controlled by a timer 168 which includes contacts 170. Actuation of timer 168 causes it to close contacts 170 after an adjustable period of time. This period of time is adjusted to be equal to the predetermined period of time for which one wishes the apparatus to display each page.

Figure 17:
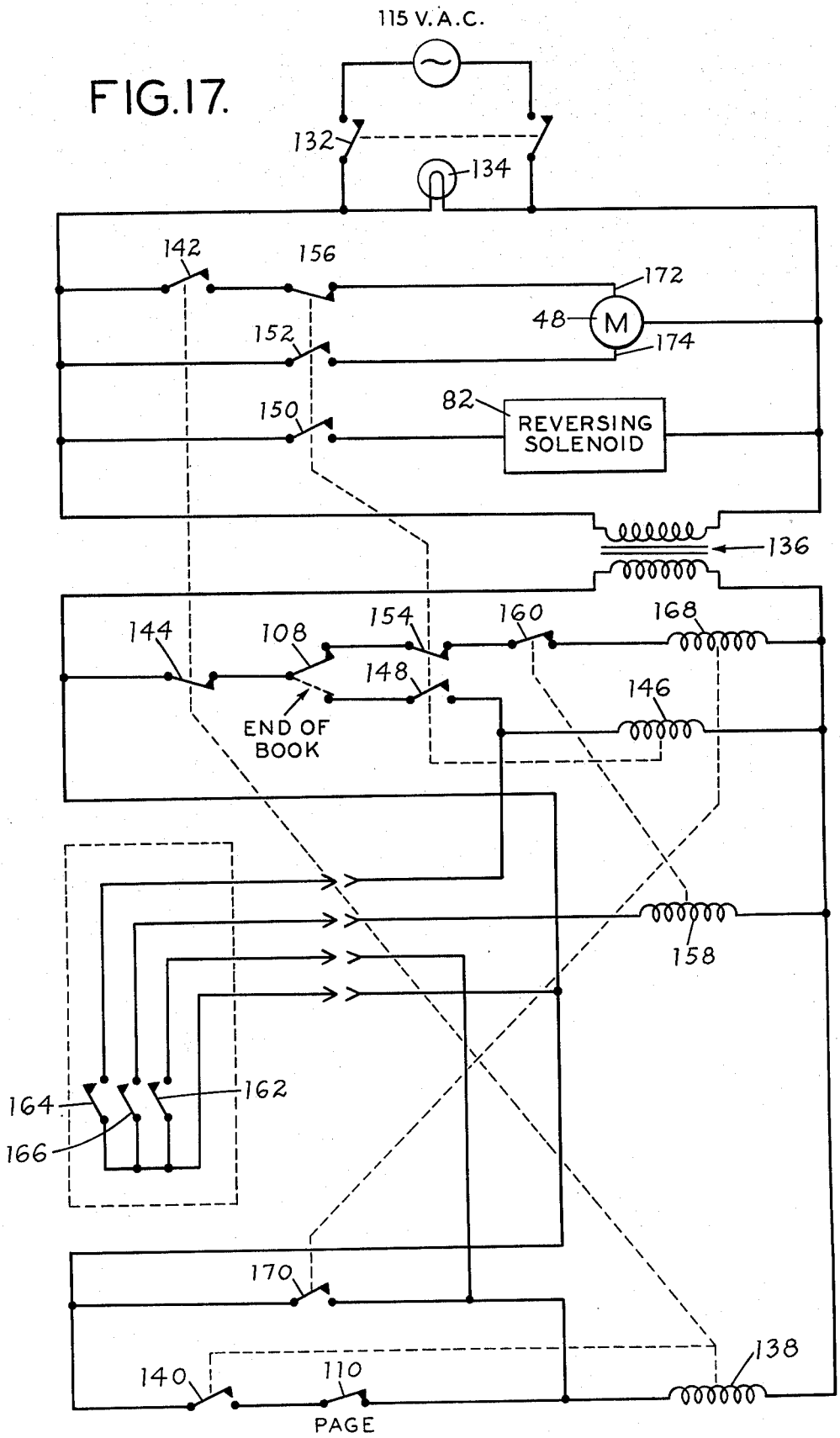
FIG. 17, is a circuit diagram of a control system for use in conjunction with the apparatus illustrated in FIGS. 1—16.

The control circuitry also includes switch 108 which is actuated by the holes 92 and 90, and switch 110 which is actuated by hole 90. In order to most clearly understand the sequence of operation of the circuitry illustrated in FIG. 17, let us first consider the situation where the reader is stopped at a page. Relay 138 is in the unactuated position as shown in FIG. 17. The contacts 148–156 of reversal relay 146 are also in the position illustrated in FIG. 17. Switch 166 is then depressed, thereby putting the contacts 160 of timer relay 158 in the closed position as illustrated in the figure. This thus actuates timer 168 to close its contacts.

However, timer 168 does not close its contacts 170 immediately upon actuation. For a period of time which may be adjusted to a desired value, contacts 170 remain open, thereby leaving relay 138 in the illustrated unactuated position with its contacts 142 open and motor 48 not activated. The user of the apparatus employs this period of time to read the page at which the apparatus is stopped. When the period of time expires, contacts 170 close, actuating relay 138 and the motor, causing the sheet to advance. Advancement of the sheet drives actuating arm 96 out of hole 90, thereby closing switch 110.

Now that the sheet has advanced neither switch 108 nor switch 110 detect the presence of a hole 90, due to the fact that the switches are positioned at a point somewhere intermediate to the holes 90. Thus, switch 110 is closed. When switch 110 is closed, power is being applied to relay 138 via contacts 140 and switch 110. Contacts 140 are closed due to prior actuation of relay 138. This resulted in maintaining contacts 140 and 142 of relay 138 closed and contacts 144 of relay 138 opened. Power is thus applied through closed contacts 156 and 142 to terminal 172 of motor 48. Motor 48 thus continues to rotate, thereby continuing to advance the sheet 4, containing the printed material. When one of the holes 90 passes over switches 108 and 110, the pointed actuating arm 96 of switch 110 extends through the hole, thereby opening switch 110. The opening of switch 110 removes power from relay 138. When power is removed from relay 138, its contacts 140 and 142 are opened and its contacts 144 are closed. The opening of contacts 142 results in removing power from terminal 172 of motor 48, thereby stopping the advancement of the sheet. This also results in the closing of contacts 144, thereby applying a pulse to timer 168, causing the timer to close its contacts after a predetermined period of time during which the reader reads the page. When its contacts 170 are closed, relay 138 is again actuated, thereby again closing contacts 140 and repeating the above-described cycle.

When it is desired to stop the automatic display of successive pages, switch 166 is again closed, thereby actuating relay 158, opening its contacts 160. This disables timer 168 thereby preventing the closing of contacts 170 after the predetermined period of time and the subsequent actuation of relay 138 which starts motor 148 when it is actuated.

In the event that the end of the sheet is detected, actuating arm 98 extends through the hole 92, thereby causing switch 108 to assume the position shown in phantom lines in FIG. 17. This disables the timer circuit, thereby preventing further advancement of the sheet. detects If it is desired to advance the reader a single page, switch 162 is actuated and thereby closed by the user, actuating relay 138, thereby applying a signal to the terminal 172 of motor 48. This activates motor 48 causing advancement of the sheet and actuation of actuating arm 96 of switch 110. This closes switch 110. Actuation of relay 138 also closes its contacts 140, thereby keeping relay 138 actuated and motor 48 activated until actuating arm 96 of switch 110 again detectts a hole 90 or 92 thereby opening switch 110 deactivating relay 138 and motor 48.

When it is desired to reverse the action of the sheet, reversal switch 164 is closed. This actuates reversal relay 146 opening its contacts 156, thereby removing power from terminal 172 and closing contacts 150 and 152. This results in actuating reversal solenoid 82 to put plate 50 in the position illustrated in phantom lines in FIG. 6, thus coupling power to the rewind gear 85. Closure of contacts 152 applies power to terminal 174 of motor 48, thereby actuating motor 48 in the reverse mode and causing rewinding of the sheet onto spool 6. Such action will continue until switch 164 is again actuated, thereby causing latching relay 146 to again assume the state illustrated in FIG. 17.

While an illustrative embodiment of the invention has been disclosed, it is understood that various modifications will be obvious to those of ordinary skill in the art. For example, holes 90 and 92 may be replaced by printed black marks or combinations of marks and said marks may be detected by an optical detector. Additional intermediate gears may be used in the transmission to change the output speed of the apparatus. Such modifications are within the spirit and scope of the invention as limited only by the appended claims.

I claim:

1. An apparatus for presenting reading material in the form of a continuous scroll having a plurality of pages of printed material in a predetermined order and control information disposed on said scroll for indicating the position of each of said pages, said material to be read by direct viewing under ambient light, said apparatus comprising:

a. a cassette having a facing portion, for containing the continuous scroll;
b. feed spool means associated with said casette for supporting said continuous scroll in roll form within said cassette;
c. means associated with said cassette for guiding said scroll along a path extending from said feed spool means and passing over said facing portion;
d. take-up spool means associated with said cassette for taking up said scroll from the guiding means;
e. console means defining an aperture large enough for the display of a portion of the reading material, said console means further defining a cassette receiving chamber, said aperture positioned on said console means in such a manner that said facing portion of said cassette is subadjacent said aperture when said cassette is in said cassette receiving chamber;
f. means for guiding said cassette into said cassette receiving chamber;
g. means associated with each of said spool means for coupling said spool means to a source of rotary drive;
h. motor means;
i. transmission means associated with said console means having first and second modes for coupling said motor means either to the coupling means associated with said take-up spool means to unwind said scroll from said feed spool means by advancing said scroll along said path past said aperture whereby successive pages of said reading material are displayed through said aperture or to the coupling means associated with said feed spool means to rewind said scroll on said feed spool means;
j. detector means for detecting said control information;
k. remote switch means for actuation by a user; and
l. control means responsive to said detector means and said remote switch means for controlling said motor means and said transmission means to cause the display of said pages, or the rewinding of said scroll.

2. Apparatus as in claim 1, wherein said means for guiding said cassette comprises rail means and mating track means which mates with said rail means.

3. Apparatus as in claim 2, wherein said rail means is secured to said console means and said track means is secured to said cassette.

4. Apparatus as in claim 1, wherein said guide means comprises:

a. first idler means for guiding the scroll from the feed spool means to the facing portion of the cassette;
b. second idler means for guiding the scroll from the facing portion to the take-up spool means; and
c. a pair of guide rails disposed over the edges of the facing portion for guiding the passage of the scroll over the facing portion.

5. Apparatus as in claim 1, wherein said control information is in the form of holes which are defined by said scroll and wherein the presence of said holes is detected by mechanically actuated switch means.

6. Apparatus as in claim 5, wherein said mechanically actuated switch means comprises at least one switch with an actuating arm appended thereto, said switch being mounted within a pivotally mounted housing which extends into said cassette receiving chamber, the actuating arm of said switch extending from said housing, said cassette defining a detector receiving aperture for receiving said housing, spring means urging said housing into a detecting portion, said housing including a cam surface which when engaged will cause said housing to be deflected into a position permitting entry of said housing into said cassette, said detecting position being a position where said actuating arm extends through the facing plate of said cassette to detect the presence of said holes in said scroll, and cam follower means for engaging said cam surface of said housing and deflecting said housing to said position where it is allowed to enter the cassette.

7. Apparatus as in claim 6, wherein said switch means comprises two separate switches, one of said switches being actuated by relatively large and small holes in said scroll and the other of said switches being actuated by relatively small holes.

8. Apparatus as in claim 1, wherein said feed spool means is releasably held within said cassette by a spring-biased member.

9. Apparatus as in claim 1, wherein said transmission means comprises:

a. a first gear mounted for rotation with the coupling means associated with said take-up spool means;
b. a second gear mounted for rotation with the coupling means associated with said feed spool means;
c. a pivotally mounted plate;
d. third gear means coupled to said motor means and mounted on said plate for coupling power to either said first gear when said plate is in a first position or said second gear when said plate is in a second position;
e. a spring for urging said plate into one of said positions; and
f. a solenoid for urging the plate into the other of said positions in response to said control means.

10. Apparatus as in claim 1, wherein said control means comprises first relay means including first and second normally open contacts, said first relay means actuable by said remote switch means to close said normally open contacts and actuable by the series combination of said first normally open contacts and an electrical switch means associated with said detector means, said second normally open contacts being coupled to said motor means to apply power to said motor means, whereby said motor means advances said scroll through successive positions where said switch associated with said detector means does not detect control information, until said scroll reaches a position where said detector means detects said control information causing actuation of said switch associated with said detector means to stop the application of power to said first relay means.

11. Apparatus as in claim 10, further comprising timer means, second relay means responsive to said remote switch means to couple said timer means to a source of power through a third set of contacts on said first relay means, said third contacts being normally closed, said timer means performing a control function a fixed period of time after actuation of said timer means, said control function resulting in the application of a pulse of power to said first relay means, whereby power is removed from said timer means through the opening of said normally closed contacts and power is applied to said motor means by the closing of said second normally open contacts of said first relay means, causing said motor means to advance the scroll and deactuate said switch means associated with said detector means, causing the application of power through said first normally open contacts of said first relay means and said switch means associated with said first detector means to said first relay means until said switch means associated with said detector means detects said control information to cause the deactuation of said first relay means and the closing of said third normally open contacts of said first relay means, resulting in the application of power to said timer means and thereby causing the successive display of pages in said scroll.

12. Apparatus as in claim 11, wherein said transmission means comprises:

a. a first gear mounted for rotation with the coupling means associated with said take-up spool means;
b. a second gear mounted for rotation with the coupling means associated with said feed spool means;
c. a pivotally mounted plate;
d. third gear means coupled to said motor means and mounted on said plate for coupling power to either said first gear when said plate is in a first position or said second gear when said plate is in a second position;
e. a spring for urging said plate into one of said positions; and
f. a solenoid for urging the plate into the other of said positions in response to said control means.

13. Apparatus as in claim 12, wherein said motor means is electrically reversable, and further comprising third relay means respective to said remote switch means to apply drive to said motor means in the reverse direction and to actuate said reversing solenoid.

14. An apparatus for the presentation of reading material in the form of a continuous scroll having a plurality of pages of printed material in a predetermined order, said apparatus comprising:

a. a cassette having a facing portion, for containing the continuous scroll;
b. feed spool means associated with said cassette for supporting said continuous scroll in roll form within said cassette;
c. means associated with said cassette for guiding said scroll along a path extending from said feed spool means and passing over said facing portion;
d. take-up spool means associated with said cassette for taking up said scroll from the guiding means;
e. console means defining an aperture large enough for the display of a portion of the reading material, said console means further defining a cassette receiving chamber, said aperture positioned on said console means in such a manner that said facing portion of said cassette is subadjacent said aperture when said cassette is in said cassette receiving chamber;
f. means for guiding said cassette into said cassette receiving chamber;
g. means associated with each of said spool means for coupling said spool means to a source of rotary drive;
h. motor means; and
i. transmission means associated with said console means for selectively coupling said motor means to said means associated with each of said spools to selectively move said scroll along said path past said aperture, displaying successive pages of said reading material through said aperture or rewinding said reading material.

15. An apparatus as in claim 14, wherein said transmission means has a first mode for coupling said motor means to the coupling means associated with said take-up spool means to unwind said scroll from said feed spool means by advancing said scroll along said path, whereby successive pages of said reading material are displayed through said aperture and a second mode for coupling said motor means to the coupling means associated with said feed spool means to rewind said scroll on said feed spool means.

* * * * *